US008739720B2

(12) United States Patent
Ford

(10) Patent No.: US 8,739,720 B2
(45) Date of Patent: Jun. 3, 2014

(54) STORABLE, SICKLE-SHAPED SAILBOAT MAST

(75) Inventor: Charles Kenneth Ford, Tallahassee, FL (US)

(73) Assignee: The Florida State Univerity Technology Transfer Office, Tallahassee, FL (US)

( * ) Notice: Subject to any disclaimer, the term of this patent is extended or adjusted under 35 U.S.C. 154(b) by 740 days.

(21) Appl. No.: 12/381,451

(22) Filed: Mar. 12, 2009

(65) Prior Publication Data

US 2009/0173264 A1 Jul. 9, 2009

Related U.S. Application Data

(63) Continuation-in-part of application No. 11/975,464, filed on Oct. 19, 2007, now abandoned.

(51) Int. Cl.
*B63B 15/00* (2006.01)

(52) U.S. Cl.
USPC ..... 114/91; 114/98

(58) Field of Classification Search
USPC ..... 114/89, 90–93, 97, 98
See application file for complete search history.

(56) References Cited

U.S. PATENT DOCUMENTS 4,074,647 A * 2/1978 Delaney ..... 114/102.22
4,697,534 A * 10/1987 Kettlestrings ..... 114/90
4,964,353 A * 10/1990 Morrelli ..... 114/39.12

* cited by examiner

*Primary Examiner* — Edwin Swinehart
(74) *Attorney, Agent, or Firm* — J. Wiley Horton

(57) ABSTRACT

A sailboat mast including a straight lower portion and a curved upper portion. The curved upper portion has an aerodynamically efficient cross section designed to reduce drag. The mast assembly is free to rotate with respect to the boat's hull in order to position the mast in line with the airflow for windward sailing, perpendicular to the airflow for downwind sailing, and at other appropriate angles for other conditions. The curved upper portion of the mast facilitates storage of the mast along a curved gunwale. The mast preferably incorporates a curved mast extension allowing an increase in the sail area beyond what is possible for a one-piece mast that is storable within the length of a boat.

1 Claim, 12 Drawing Sheets

STORABLE, SICKLE-SHAPED SAILBOAT MAST

CROSS-REFERENCES TO RELATED APPLICATIONS

This application is a continuation in part of U.S. application Ser. No. 11/975,464, which has a filing date of Oct. 19, 2007 now abandoned.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

1. Field of the Invention

This invention relates to the field of watercraft. More specifically, the invention comprises a curved mast assembly for a sailing vessel.

2. Description of the Related Art

Masts have been used on sailing vessels for many centuries. They typically have a straight central axis, though they often taper from the base to the tip. FIG. 1 shows a prior art sailing boat 10 equipped with a conventional straight mast 14. Straight mast 14 is placed within mast step 22, thereby attaching it to hull 12.

Cables are typically used to reinforce the mast. These run between the top of the mast and various attachment points on the hull. These reinforcing cables are collectively referred to as the "standing rigging."

Other conventional components are shown in FIG. 1 as well. Boom 16 is attached to the mast near its base. Main sail 18 bridges the space defined by the mast and the boom. Jib 20 is rigged forward of the mast. Many other well-known components are shown in FIG. 1. These include a tiller, several thwarts, a transom, and an adjustable main sheet.

Those skilled in the art will realize that the craft shown in FIG. 1 is fairly small. It is of a type well-suited to fishing, in that it has a significant amount of useable space. However, that space is encumbered by the presence of the mast, boom, sails, and associated rigging. In order to use the vessel for fishing, it is desirable to take down and stow these components.

FIG. 2 shows the same boat after the sails, mast, and rigging have been taken down. Base 28 of mast 14 has been removed from mast step 22 and the mast laid down in the boat. Furled sails and associated rigging have been omitted for purposes of visual clarity.

The reader will observe that the mast does not fit within the boat's curved gunwales 36. If base 28 is placed in the vicinity of stern 62, then tip 26 extends well out the sides of bow 24. Of course, the mast could be placed along the boat's centerline, but this would make movement within the boat difficult. The prior art mast cannot be efficiently stored along the gunwale, since the protruding tip interferes with fishing activity.

Aerodynamic drag is another issue with prior art masts. The mast of a moving sailboat must "slice" through the relative wind moving over the boat. The straight mast shown in FIG. 1 is akin to the straight wing airfoils used on older aircraft. A "swept" airfoil will reduce the aerodynamic drag. Thus, a mast design which improves upon the drag created by a straight mast is desirable.

The ability to vary the sail area over a broad range is likewise desirable. The main sail can be raised and lowered to present larger and smaller surface areas respectively. However, the upper limit of surface area is conventionally reached when the top of the main sail is raised to the top of the mast. For days having relatively light wind, it is desirable to further increase the sail area. This is ideally done via providing an extendable mast top.

BRIEF SUMMARY OF THE INVENTION

The present invention comprises a sailboat mast including a straight lower portion and a curved upper portion. The curved upper portion preferably has an aerodynamically efficient cross section designed to reduce drag. The mast assembly is free to rotate with respect to the boat's hull in order to position the mast in line with the airflow for sailing to windward, perpendicular to the airflow for downwind sailing, and at other appropriate angles for other conditions. The curved upper portion of the mast facilitates storage of the mast along a curved gunwale.

The curved upper section also reduces wind drag when compared to a conventional straight mast. The pivoting lower section allows the entire mast to rotate so that the plane in which the curve of the upper section lies can be approximately aligned with the air flow over the boat.

The invention preferably includes an extendable upper mast. This feature allows the total mast height to be increased, thereby allowing a greater sail area under appropriate conditions. The extendable portion preferably includes a radius of curvature which is about the same as the curvature of the main mast, so that the extendable portion can be extended over a variable distance.

REFERENCE NUMERALS IN THE DRAWINGS

| | | | |
|---|---|---|---|
| 10 | boat | 12 | hull |
| 14 | straight mast | 16 | boom |
| 18 | main sail | 20 | jib |
| 22 | mast step | 24 | bow |
| 26 | tip | 28 | base |
| 30 | curved mast | 32 | pivoting base |
| 34 | arcuate portion | 36 | curved gunwale |
| 38 | constant radius arc | 40 | mast extender |
| 42 | mast cross section | 44 | main halyard tunnel |
| 46 | jib halyard tunnel | 48 | mast half |
| 50 | split line | 52 | luff tube |
| 54 | reinforced fiber jacket | 56 | slug |
| 58 | web | 60 | luff channel |
| 62 | stern | 64 | web anchor |
| 66 | keel | 68 | mast joint |
| 70 | main sheet | 72 | straight mast |
| 74 | curved mast | 75 | mast bearing |
| 76 | mast rotation axis | 78 | upper region |
| 80 | lower region | 82 | middle region |
| 83 | leading point | 84 | upper region |
| 86 | relevant wind | 88 | pressure differential |
| 90 | perpendicular of mast rotation axis | | |
| 92 | downwash | 94 | upwash |

DETAILED DESCRIPTION OF THE INVENTION

Figure 1:
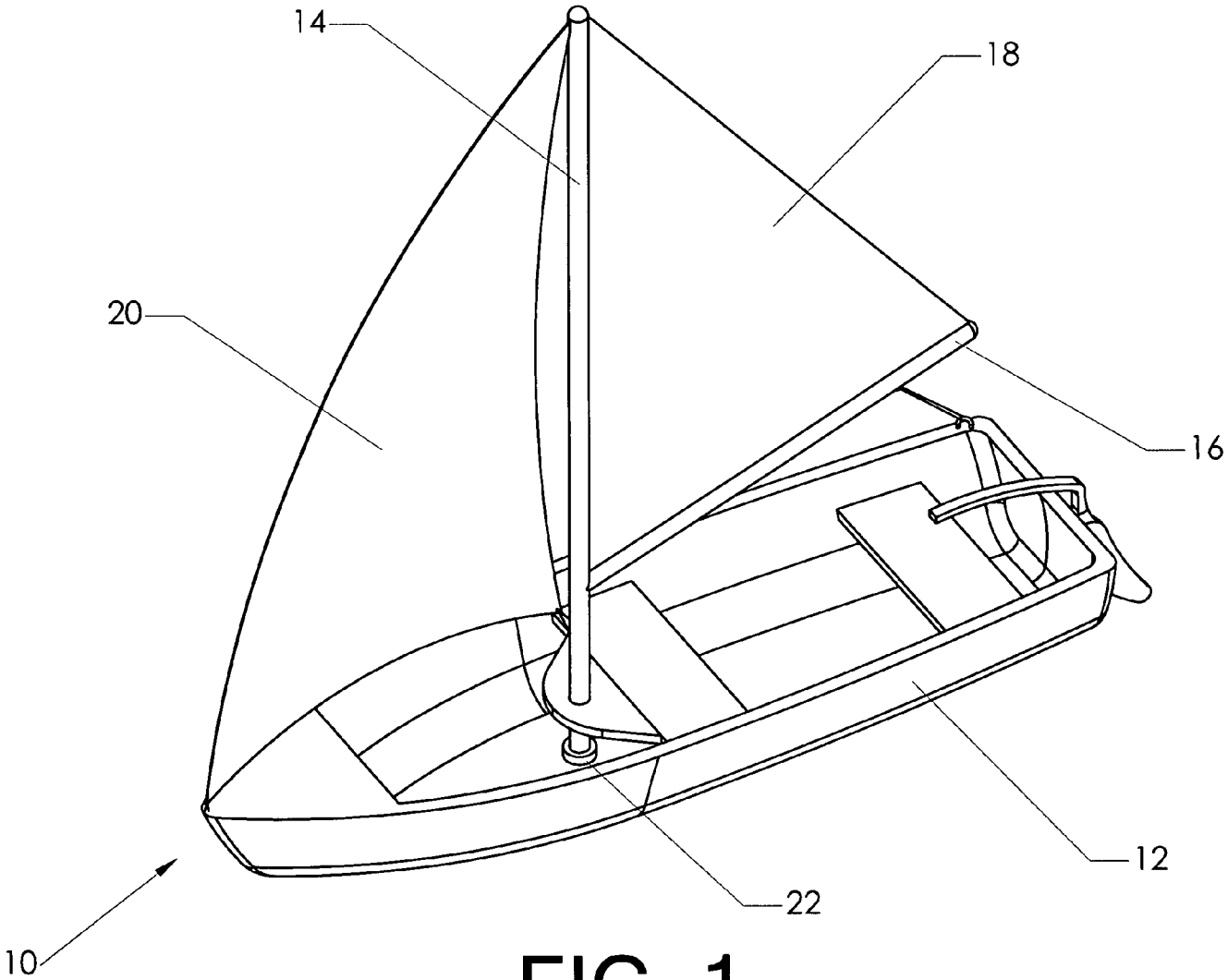
FIG. 1 (PRIOR ART)
FIG. 1 is a perspective view, showing a prior art sailing vessel having a straight mast.
Figure 2:
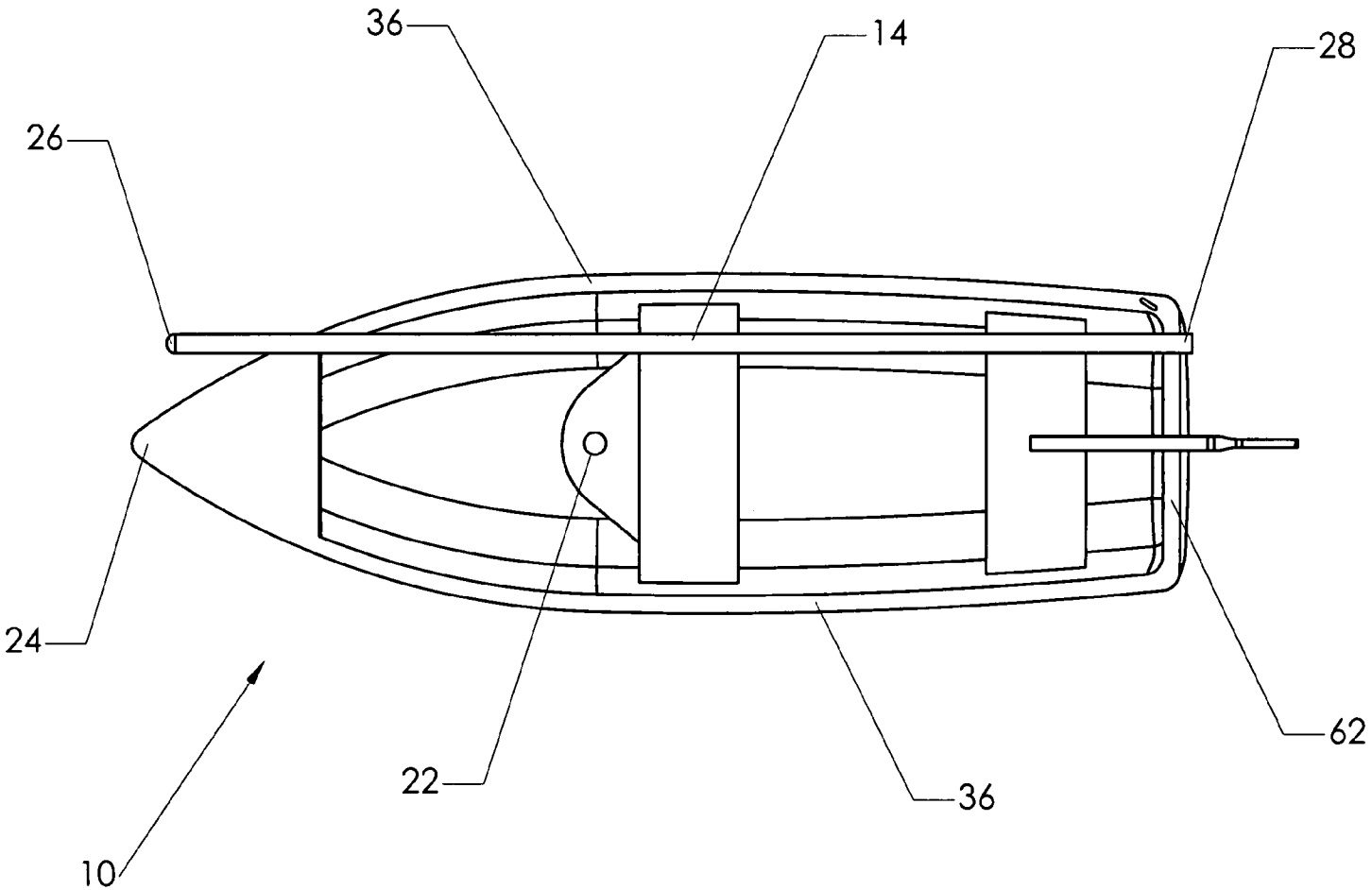
FIG. 2 (PRIOR ART)
FIG. 2 is a perspective view, showing the vessel of FIG. 1 with its mast removed and stowed.
Figure 3:
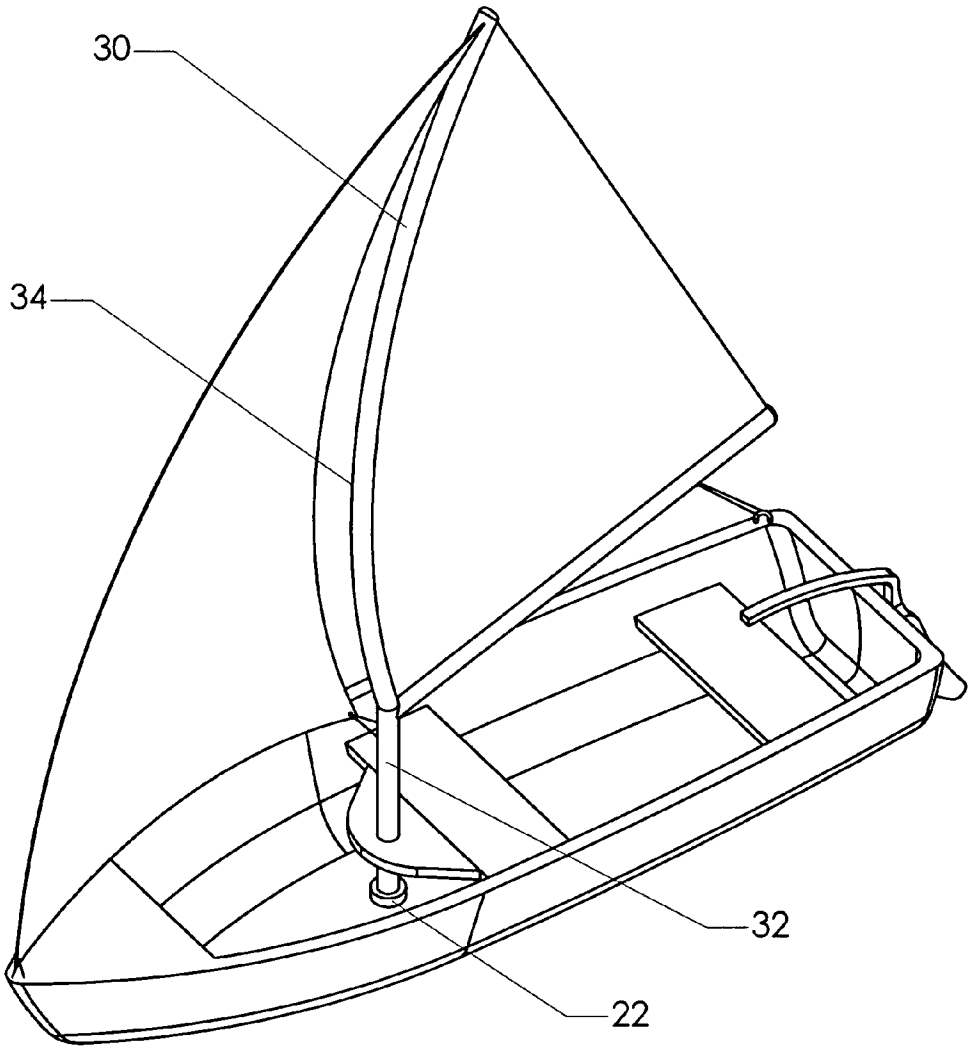
FIG. 3 is a perspective view, showing a curved mast made according to the present invention.

FIG. 3 shows a mast made according to the present invention. Curved mast 30 includes arcuate portion 34 joined to pivoting base 32. Pivoting base 32 is pivotally attached to mast step 22 so that the mast can rotate with respect to the hull. The other components—such as the sails—are modified to conform to the mast's curvature. The reader will observe how the modified main sail has an arcuate leading edge, whereas prior art sails have a straight leading edge.

Figure 4:
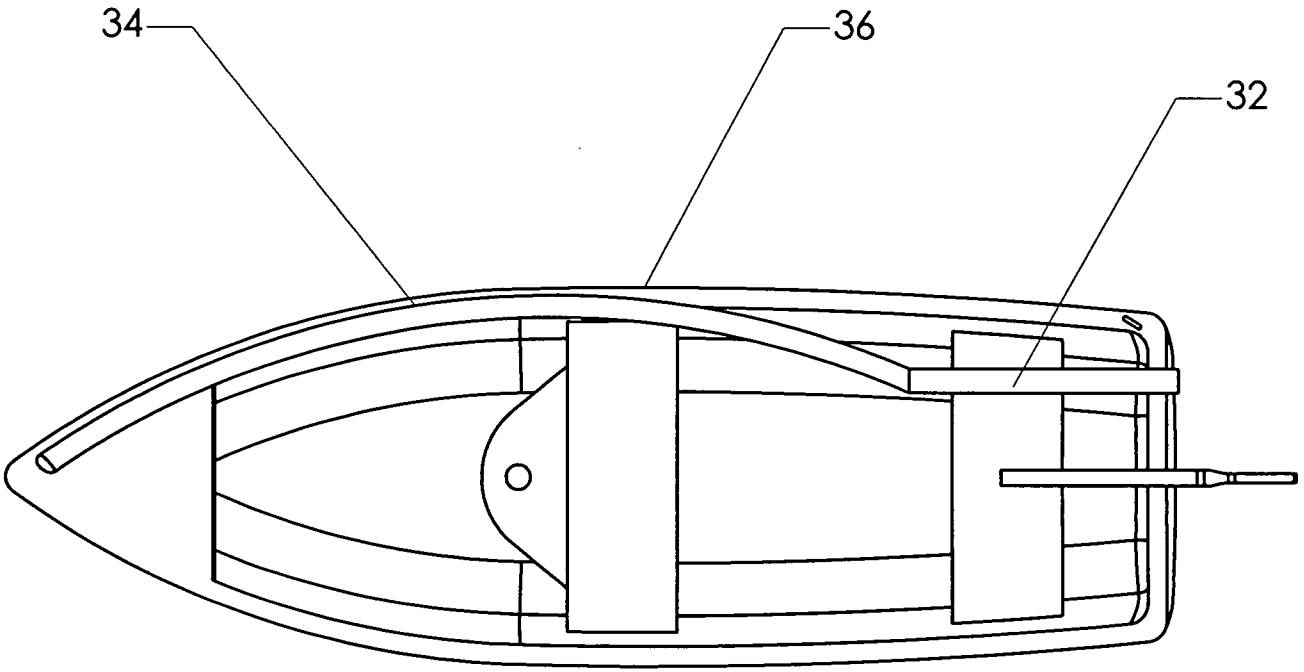
FIG. 4 is a perspective view, showing the vessel of FIG. 3 with its mast removed and stowed.

As for the prior art, curved mast 30 is preferably removable so that it can be stored within the boat. FIG. 4 shows the mast removed. The reader will observe how arcuate portion 34 lies along curved gunwale 36. While the curved mast still consumes some volume within the boat, it does not protrude significantly beyond the boat. Thus, it does not interfere with fishing and other activities.

Prior art masts do not typically rotate with respect to the hull. Instead, the boom and main sail pivot around the fixed mast. The pivot may actually be a pinned joint or—in more traditional designs—a pair of boom jaws may rotate around the cylindrical external surface of the mast. The curved mast used in the present invention, however, is preferably constructed so that it is free to rotate as a whole.

Figure 5:
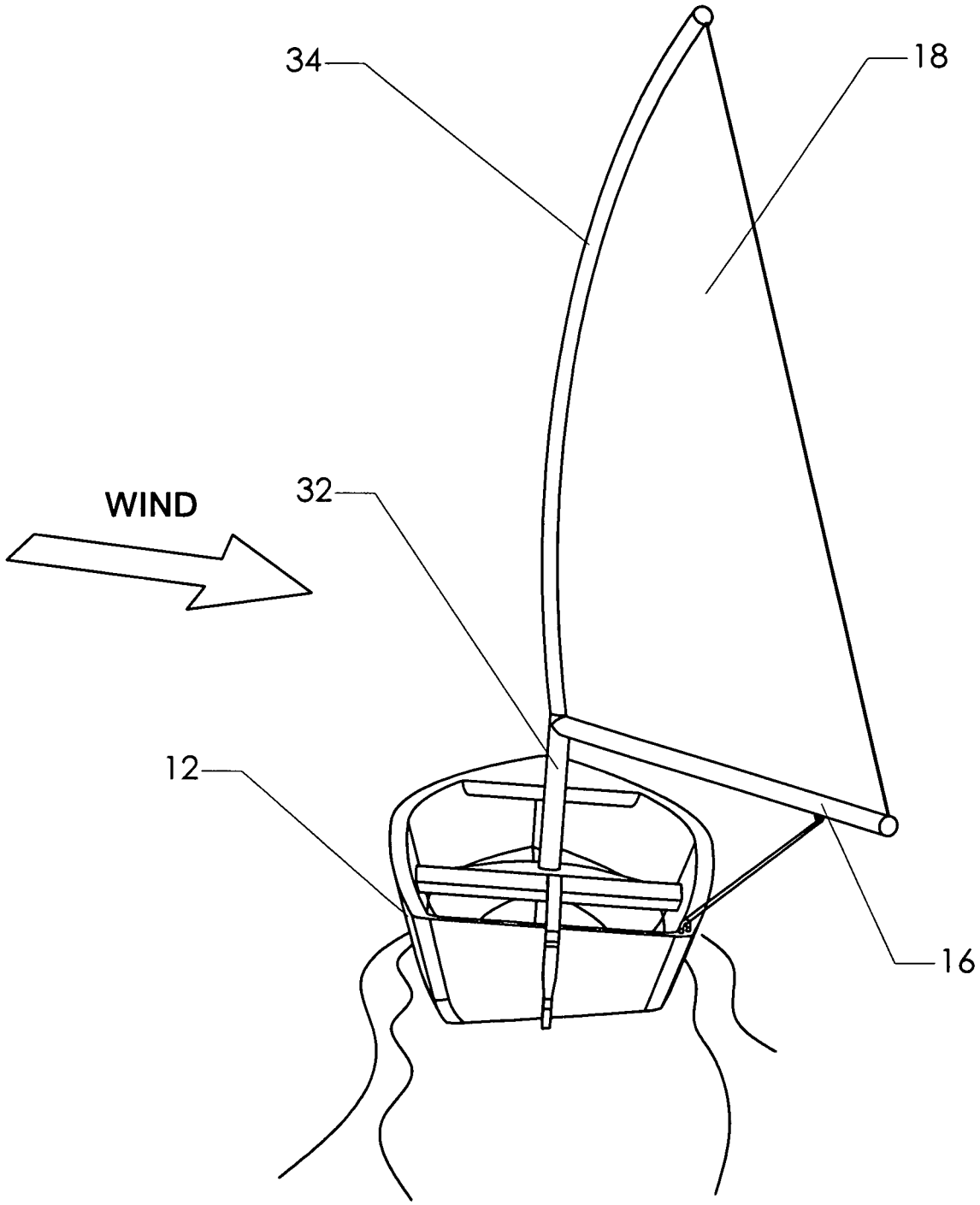
FIG. 5 is a perspective view, showing the rotation of the curved mast in order to accommodate varying relative wind direction.

FIG. 5 graphically illustrates the need for this feature. A sailboat underway encounters wind flowing from many different directions. FIG. 5 shows a boat sailing on a "close reach." Its course is about 40 degrees off sailing directly into the wind. The curved mast has rotated so that the plane in which arcuate portion 34 lies is approximately parallel to the wind direction. This rotation allows even tension on the mainsail.

Returning briefly to FIG. 3, those skilled in the art will realize that if the curved mast is not allowed to rotate, the boom must rotate about the mast in order to set the main sail's angle of attack (as for the prior art). However, if the boom rotates without the mast rotating, even tension cannot be maintained on the main sail due to the mast's curvature (and the resulting curvature of the sail's leading edge). Thus, the curved mast is preferably designed to rotate in unison with the boom. This is a substantial departure from prior art designs, where the boom is generally free to rotate with respect to the mast. In the present invention, the boom end nearest the mast is preferably locked to the mast so that when the wind pressure rotates the sail and the attached boom, the boom will rotate the curved portion of the mast into a favorable orientation (so that the curve is "slicing" into the wind).

It may be desirable in some instances to allow the boom to move with respect to the mast in the pitch axis. Thus, a pivoting joint may be provided which allows the boom to be adjusted in pitch with respect to the mast. It may also be desirable to provide a small angular offset between the boom and the plane in which the curvature of the mast lies. This is preferable because the boom will rarely be aligned perfectly with the wind direction. The boom will more likely be offset 15 to 20 degrees from the wind direction. Thus, a comparable 15 to 20 degree offset between the boom and the plane in which the curvature of the mast lies can be provided. This would allow the boom to assume the optimum orientation while the curvature of the mast is pointed directly into the wind. However, once the angle between the boom and mast is fixed it should be locked in position so that the boom rotates with the mast.

Of course, differing wind conditions may mean that a differing angular offset between the mast and the boom is preferable. The angular offset can be made adjustable by any mechanism which allows the angular offset to be set, and then locks the boom to the mast so that they rotate in unison. A simple rope and pulley with a locking mechanism on the rope can be used for this purpose.

Those skilled in the art will realize that only the curved portion of the mast gains an advantage by being free to rotate. Returning to FIG. 5, the reader will appreciate that only arcuate portion 34 needs to rotate. However, if the straight lower portion of the mast rotates as well, it will not alter the performance of the device (since a rotating vertical cylinder presents the same external surface no matter what the degree of rotation). Thus, the rotational joint can be provided in many different locations. It can be as low as the coupling between the bottom of the straight lower portion and the boat. On the other hand, the rotational joint can be as high as the lower extreme of the mast's arcuate portion.

Figure 6:
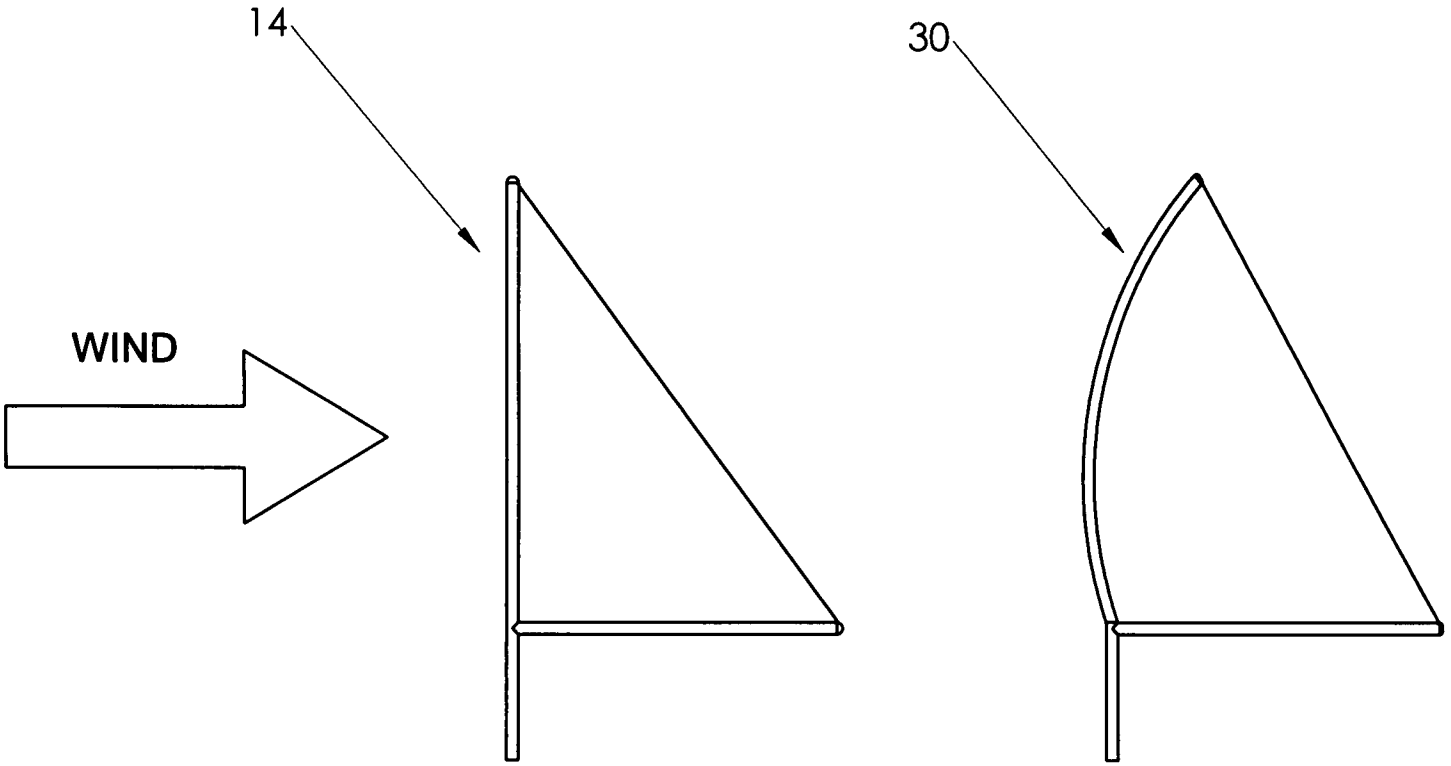
(PRIOR ART) FIG. 6
FIG. 6 is an elevation view, comparing a prior art mast to the present invention.

The storage efficiency is one advantage of the curved design. Other advantages exist as well. FIG. 6 is an elevation view showing a comparison of a prior art straight mast to curved mast 30. The wind flow is indicated by the arrow (Those skilled in the art will realize that the flow shown corresponds to a vessel sailing on a "close reach"). It is intuitively obvious that curved mast 30 produces less overall drag than straight mast 14. The curved mast acts like a bird's wing slicing through the air. It thereby reduces overall drag and increases the sail's efficiency.

The embodiments illustrated in FIGS. 3 through 5 show arcuate masts having a constant radius of curvature. In this disclosure, the word "arcuate" should be understood to encompass a variety of curved shapes. Other embodiments are possible in which the radius of curvature is not constant. These embodiments might use a parabolic arc, an elliptical arc, or other second or higher order functions. However, the use of a simple constant radius arcuate portion has advantages.

Figure 7:
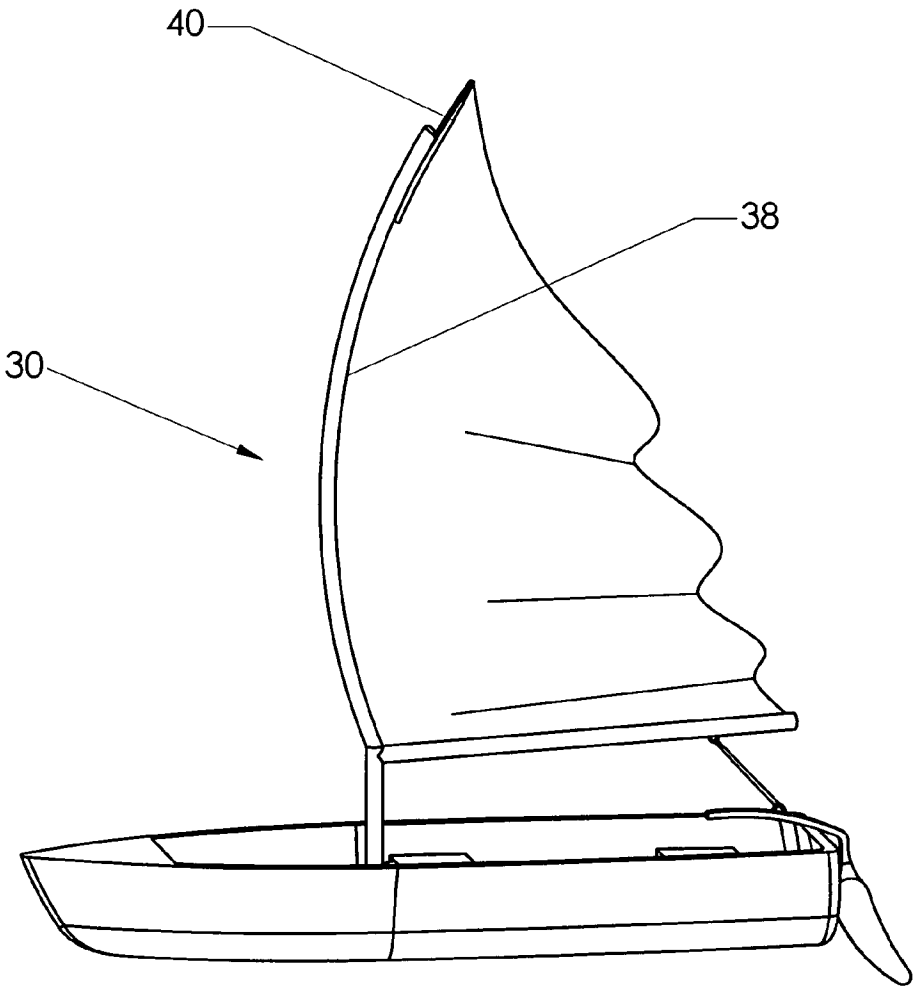
FIG. 7 is an elevation view, showing the use of a constant-radius arc for the curved mast and an arcuate mast extender.
Figure 8:
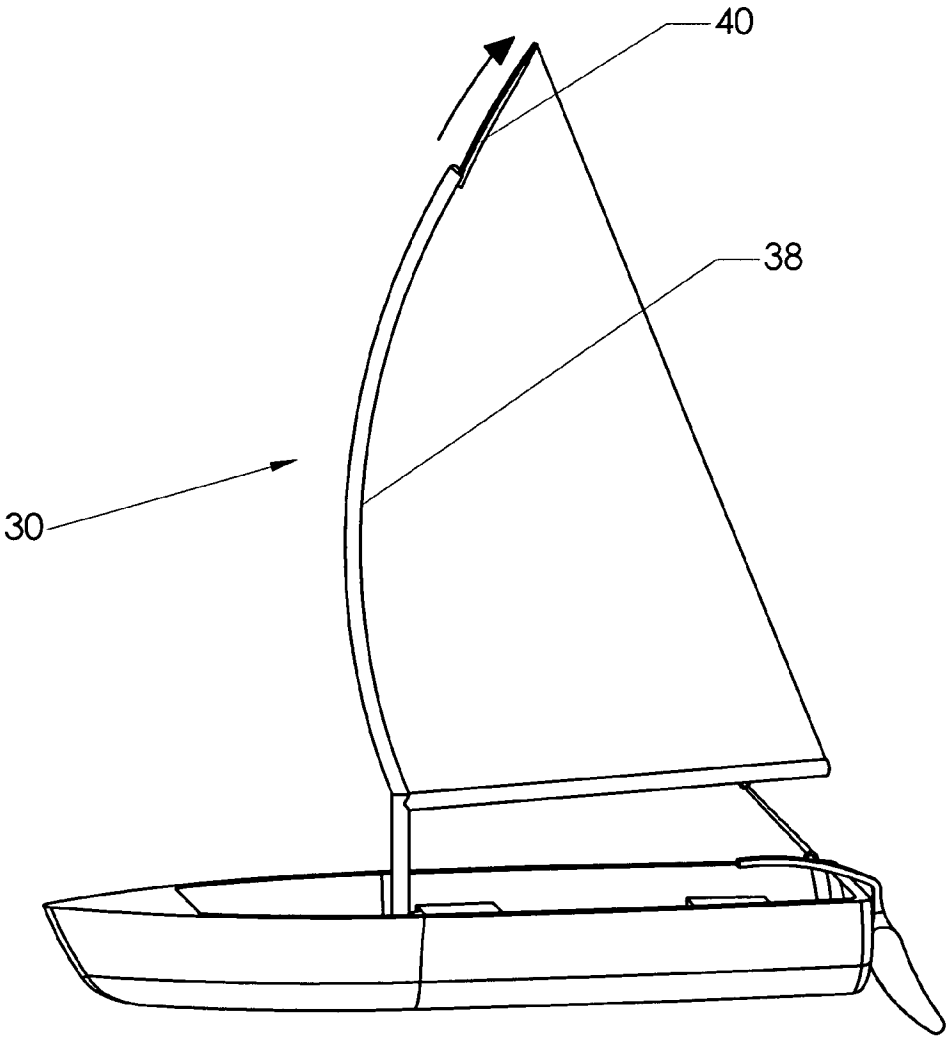
FIG. 8 is an elevation view, showing the operation of the arcuate mast extender.

FIGS. 7 and 8 show an embodiment of the curved mast in which the arcuate portion has a constant radius of curvature (designated as constant radius arc 38). A channel can be provided within the mast's aft portion. The sail can be attached using this channel, such as by sliding slugs attached to the sail's forward edge into the channel (typical in the prior art). These slugs allow the sail's leading portion to slide up and down with respect to the mast. The sail is typically pulled upward using a tensile line that passes over a pulley near the top of the mast and is then attached to the top of the sail—the tensile line being commonly known as a "halyard."

The channel can also be used to slidably attach a mast extension. In FIG. 7, mast extender 40 is slidably attached to curved mast 30. The mast extender is preferably given the same radius of curvature as the mast itself. The top of the main sail is attached to the top of the mast extender. The mast extender is then hauled up the mast—typically using a halyard assembly in which the free end of the halyard is attached near the bottom of the mast extender. The halyard preferably passes over a pulley located near the top of curved mast 30. The other end of the halyard terminates down near the bottom of the mast, where it can be grasped and pulled by a sailor. When the sailor pulls downward on the halyard, the mast extender is advanced upward.

In most embodiments the mast extender would be attached to the top of the main sail itself. It would remain in this position even when the sail is lowered. As an example, it would be possible to lower the mast extender halfway down the height of the curved mast and eventually all the way to the bottom of the curved mast. In a lowered position, the user could grasp and adjust the mast extender.

FIG. 7 shows mast extender 40 just as its tip has started to extend beyond the tip of the mast. FIG. 8 shows mast extender 40 after it has been fully extended. A stop locks it into position. The mast extender allows the mast to be shorter while still retaining the same sail area. A shorter mast is, of course, easier to stow.

Many types of sliding joints can be used to connect the mast extender to the curved mast. One approach is to construct the mast extender as a curved tube which slides within a curved cylindrical luff channel in the trailing edge of the curved mast. One could also pass the curved tube through a series of C-shaped brackets on the mast's trailing edge. Many other possibilities exist. If a curved mast extender is used, the luff channel in the upper portion of the mast must match the curvature of the curved mast extender. Of course, the balance of the mast could use a different radius of curvature or even a parabolic or other profile.

Having now received an explanation of the curved mast's general shape and operation, the reader may wish to know possible internal details of the mast's construction. The mast can actually be constructed using a variety of known techniques. Thus, the example given should be viewed as only one embodiment among many possibilities.

Figure 9:
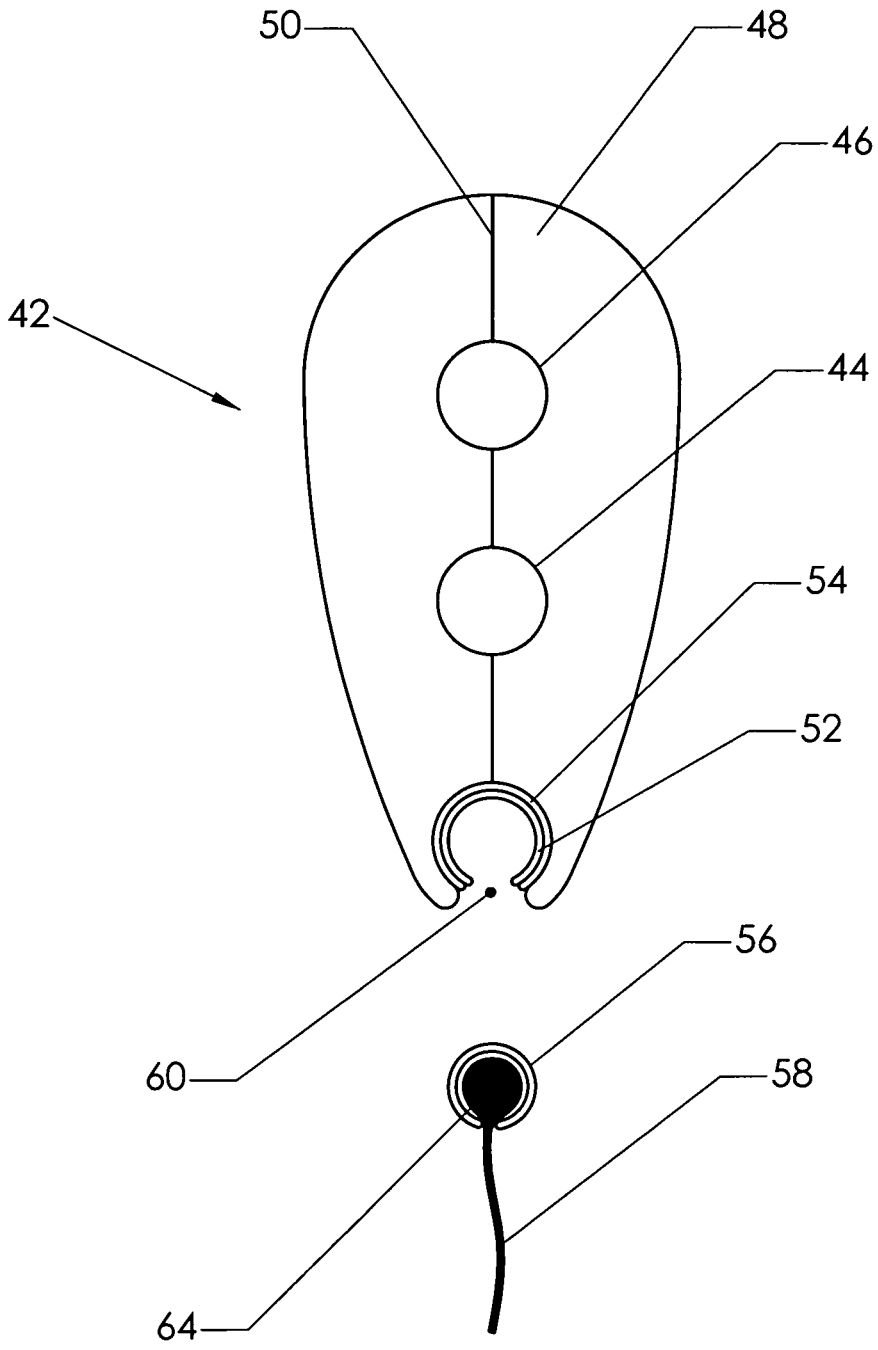
FIG. 9 is a sectional view, showing internal details of the mast's construction.

The mounting base portion can be conventional (excepting the necessity of the pivot joint). FIG. 9 shows a cross section through the arcuate portion. The mast preferably includes several internal cavities. It therefore makes sense to build the mast in two halves which are then bonded together. FIG. 9 shows mast cross section 42 comprised of two mast halves 48 bonded together. Each mast half includes voids which join to form tubular cavities running from a point above the mast step at the beginning of the arcuate portion of the mast to the top of the mast. The example shown accommodates a rigging for a main sail and a jib. Jib halyard tunnel 46 allows the passage of the jib halyard while main halyard tunnel 44 allows the passage of the main halyard.

Luff tube 52 preferably runs for most of the mast's height. Its aft portion is left open to form luff channel 60. The lower portion of the luff tube is left open on the bottom so that slugs 56 can be placed in the tube and then advanced upward by placing tension on the halyard. A series of such slugs 56 are used to attach the sail to the mast. Each slug is preferably a hollow "C" shape as illustrated. A series of web anchors 64 are placed in the hollow lugs. Each web is joined to the sail cloth itself. The web anchor can be formed by a variety of means, such as melting a portion of the web so that it deforms and fills the hollow center of the slug.

As explained previously, mast extender 40 is also slidably engaged with the luff tube. Additional slugs can be used to attach the mast extender. Since these must carry a significant load, they are typically made as a close sliding fit with the interior of the luff tube.

The hollow tubes running within the mast may be reinforced, such as by adding a reinforced fiber jacket embedded into epoxy resin. Since the material surrounding the luff tube must withstand substantial mechanical forces, reinforced fiber jacket 54 is preferably provided around luff tube 52.

The internal tubes can be simple voids in the mast material itself. However, they may also include metal or plastic liners in order to reduce friction. Likewise, the construction of the mast components could be altered while still practicing the fundamental aspects of the proposed invention.

Figure 10:
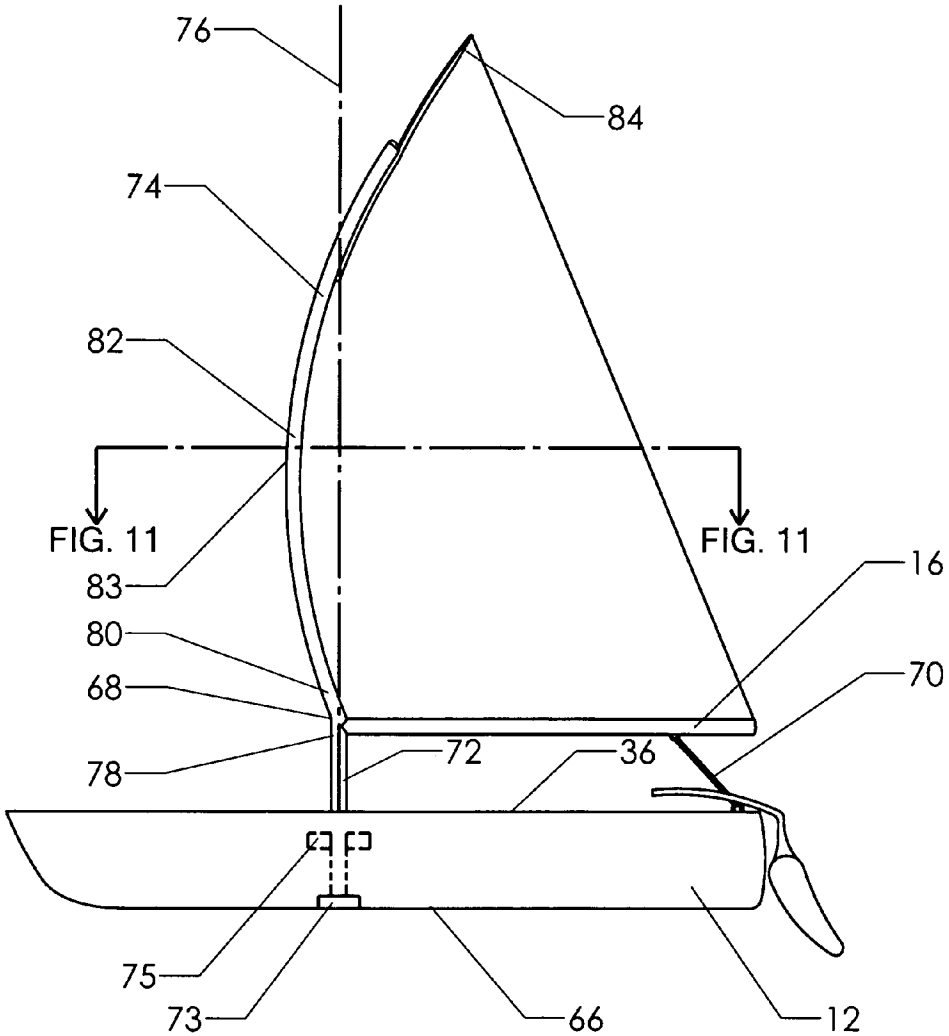
FIG. 10 is an elevation view, showing details of the curved mast configuration.
Figure 11:
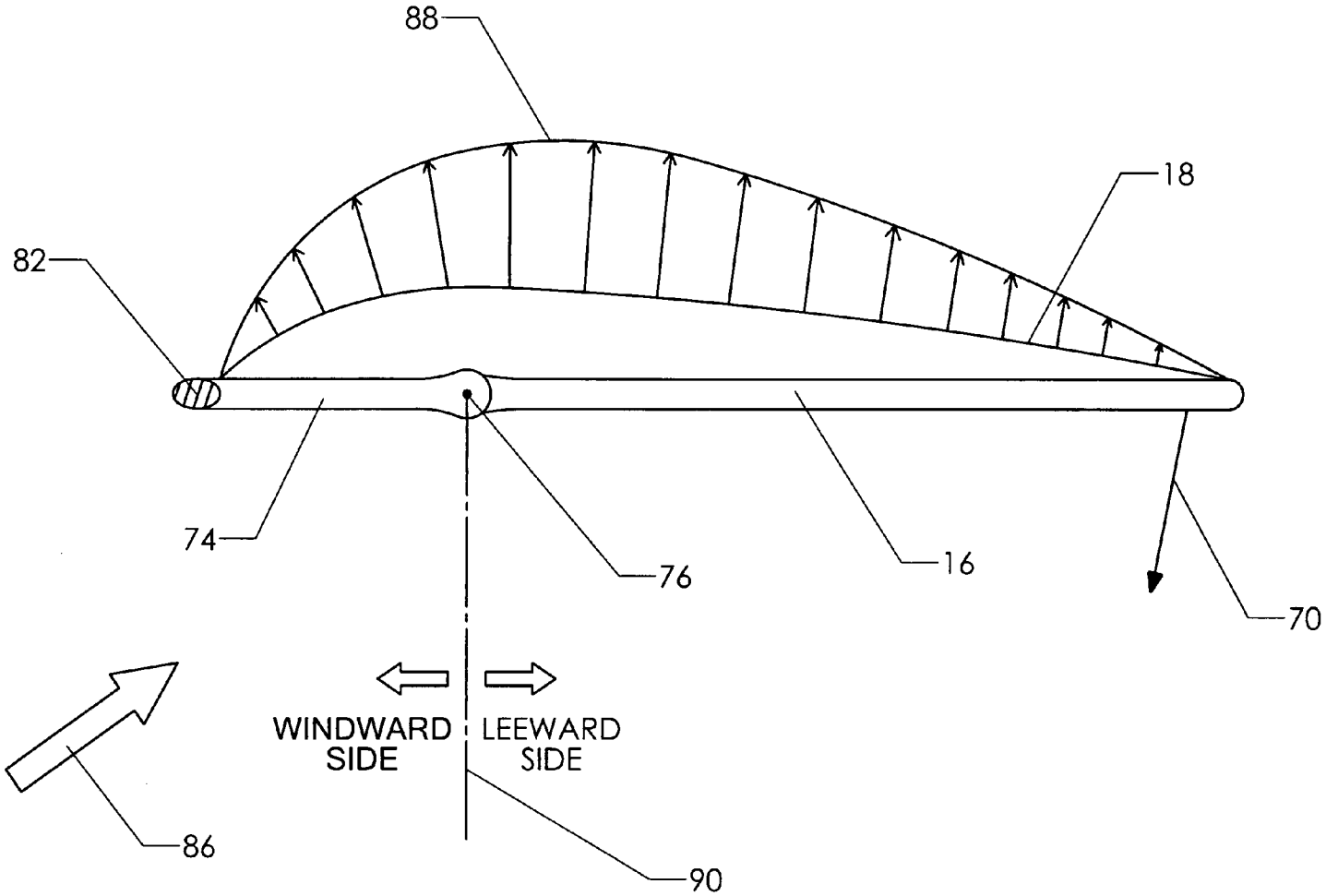
FIG. 11 is a sectional plan view, showing details of the curved mast configuration.
Figure 12:
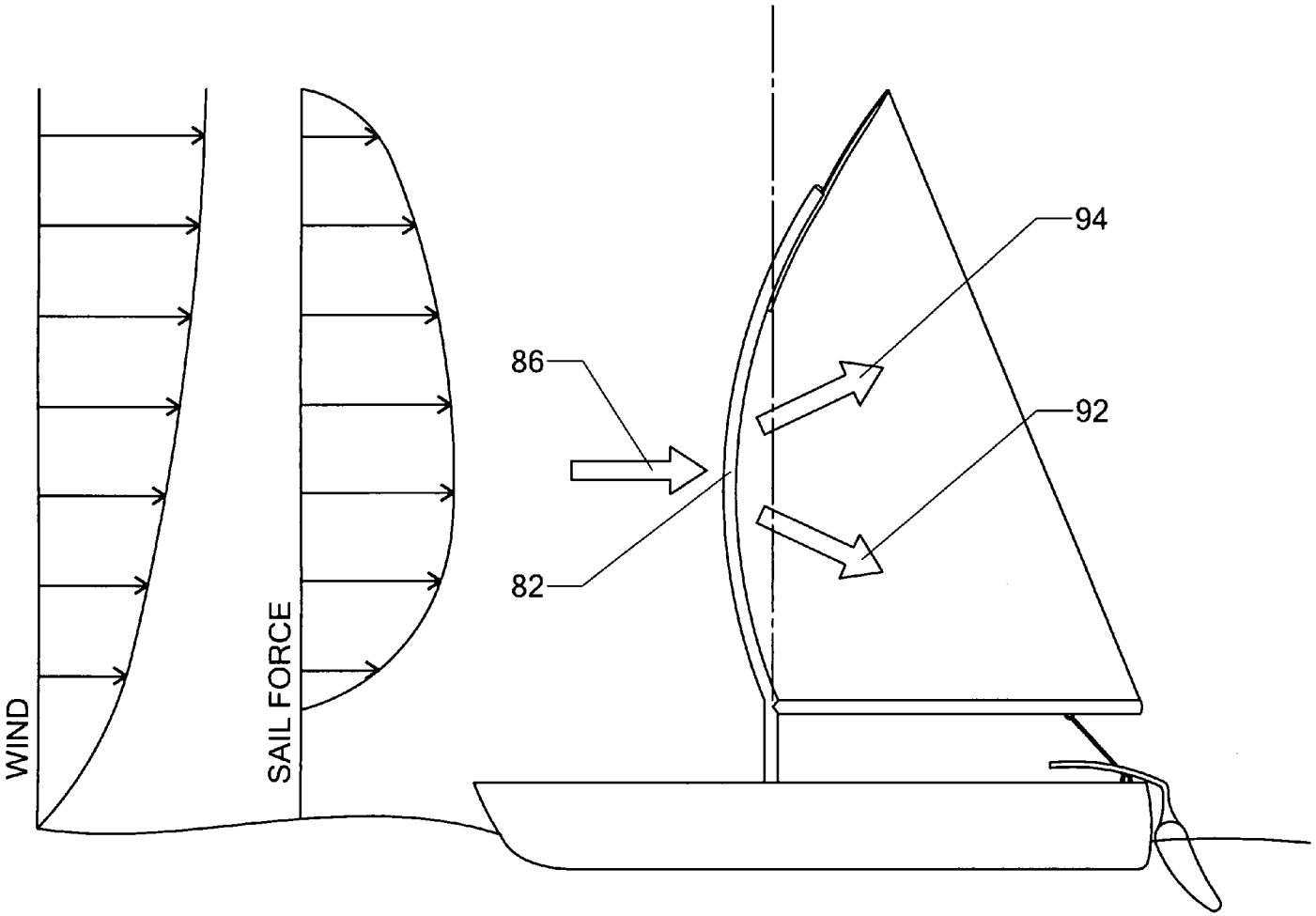
FIG. 12 is an elevation view, showing air flow over the mast assembly.

The advantages provided by the present invention are somewhat complex and some additional nomenclature may aid the reader's understanding. FIGS. 10-12 provide additional details for a preferred embodiment. FIG. 10 is an elevation view showing the mast assembly in position. The mast assembly includes two major components—straight mast 72 and curved mast 74. These two major components are rigidly joined at mast joint 68. Straight mast 72 is pivotally mounted to hull 12 at pivot joint 73. The mast assembly is further secured by a bracing component such as mast bearing 75. The mast bearing is attached to the hull and it transmits the lateral loads applied by the mast. The entire mast assembly is thereby forced to rotate about mast rotation axis 76.

The term "mast bearing" in this context means any device which prevents straight mast 72 from swaying from side to side. Numerous such devices are known in the art. Whatever embodiment is actually used, it is important that the mast rotation axis 76 it creates be substantially perpendicular to keel 66 of hull 12. In this configuration, mast rotation axis 76 will be substantially perpendicular to the surface of the water when the vessel is afloat.

Upper region 78 of straight mast 72 extends up to mast joint 68. It is important that the straight mast extend considerably upward from gunwales 36. The reason for this is that boom 16 is attached to the mast assembly proximate mast joint 68. The boom must be free to swing back and forth across the vessel as the relative wind changes. There must generally be clearance beneath the boom for the vessel's operators to safely sit within the vessel. For a typical vessel, there should be about 50 cm of clearance between the boom and the top of the gunwales. Thus, the upper region of the straight mast preferably extends upward about 50 cm beyond the gunwales.

Curved mast 74—as explained previously—can assume a variety of curved forms, including simple arcs and parabolas. It is shown in FIG. 10 as including a mast extender. However, a solid mast extending all the way to the upper tip of the extender shown in the view could just as easily be used. FIG. 10 is presented to explain some of the constraints which are important to the design, and these constraints apply whether or not a mast extender is used.

Curved mast 74 is generally divided into three regions: lower region 80, middle region 82, and upper region 84. The reader will observe that lower region 80 lies essentially on mast rotation axis 76. Middle region 82 lies well forward of mast rotation axis 76, while upper region 84 lies well aft of mast rotation axis 76. Of course, the terms "forward" and "aft" have potentially ambiguous meanings when applied to a mast assembly that—by definition—rotates. FIG. 11 resolves this definitional issue.

FIG. 11 shows a sectional plan view taken through the mast as indicated in FIG. 10. Although FIG. 11 is looking down toward the boat hull, the hull has been omitted for visual clarity. Mast rotation axis 76 is coming out of the page directly toward the viewer. Curved mast 74 extends to the left in the orientation shown in the view (ending in the section through middle region 82). Boom 16 extends to the right in the view. Main sheet 70 (usually a tensile line connecting the free end of the boom to the hull) is used to control the rotate of the assembly about mast rotation axis 76.

A sailor will orient the boom and sail so that the wind properly flows over the sail and propels the vessel. The sail must be oriented like an airfoil in an airplane. As the vessel moves forward, the combination of the actual wind direction and the vessel's motion produces the relative wind which flows over the sail (Those skilled in the art will know that the "relative wind" can be derived by summing vectors). FIG. 11 shows a typical relative wind 86 as it flows over main sail 18. Using airfoil terminology, the main sail has been oriented to produce a positive angle of attack.

Perpendicular of mast rotation axis 90 is simply an axis drawn perpendicularly to mast rotation axis 76 (It is also perpendicular to the plane in which the curved mast lies). It is used to provide a directional reference which is helpful in defining the mast geometry. The mast and sail assembly is optimized for sailing in the orientation shown in FIG. 11. That is, the assembly is optimized for sailing into an apparent wind such as the one shown. Those components lying to the left of perpendicular of mast rotation 90 in the orientation shown in the view are said to lie on the "windward" side of mast rotation axis 76. Those components lying on the opposite side are said to lie on the "leeward" side. Another way of stating this proposition is that the leeward side is the side occupied by the boom, while the windward side is the opposite of the side occupied by the boom.

Of course, those skilled in the art will realize that when the vessel is sailing downwind, the apparent wind would be coming from the "leeward" side. However, as the present invention is optimized for sailing toward the wind, the nomenclature depicted in FIG. 11 is conventional and appropriate.

Returning now to FIG. 10, some significant features of the invention will be explained in more detail. The reader will appreciate that curved mast 74 lies in a particular position and orientation with respect to mast rotation axis 76. Middle region 82 lies substantially on the windward side of mast rotation axis 76, while upper region 84 lies substantially on the leeward side. This feature places a significant portion of the sail area forward of the mast rotation axis. It also places leading point 83 (The point of middle region 82 which is furthest from mast rotation axis 76 and therefore the furthest point into the wind in optimized operation such as shown in FIG. 11) well above the boat's gunwales. In fact, leading point 83 preferably lies at a position between about ⅓ and about ⅔ of the mast assembly's total height.

FIG. 11 shows a plot of pressure differential across the sail. Those skilled in the art will know that the apparent wind must split and flow over the sail. The portion flowing over the side of the sail facing the apparent wind has a shorter path than the portion flowing over the back side. The portion flowing over the back side must therefore undergo an increase in velocity. According to Bernoulli's equation, the portion flowing over the back side will also experience a pressure drop.

Pressure differential 88 is a plot of the pressure difference between the side of the sail facing the apparent wind and the back side. The pressure differential rise rapidly when proceeding from middle region 82 toward mast rotation axis 76, before gradually tapering toward the sail's trailing edge. The placing of middle region 82 well on the windward side of mast rotation axis 76 means that a large but minority portion of the available pressure is attempting to rotate the assembly in the clockwise direction (in the orientation shown in the view). The majority of the pressure differential acts to rotate the assembly in an anticlockwise direction. Thus, placing a portion of the sail on the windward side of the mast rotation axis 76 reduces the amount of tension placed on main sheet 70 (by reducing the total net torque on the mast assembly) and reduces the controlling forces needed to adjust the rotation of the whole assembly. At least about 5% of the sail's total area is preferably placed forward of the mast rotation axis, with up to 30% of the total area being suitable in some applications.

FIG. 12 illustrates another advantage of the placement and orientation of the curved mast. The view shows a plot of wind, illustrating how it tends to increase when moving away from the water's surface. The view also shows a plot of sail force, illustrating how the fact that the wind velocity increases with increasing height tends to increase sail force (even though the sail area diminishes with increasing height).

Those skilled in the art will know that wind striking a sail tends to flow upward and "wash" off the top. This is sometimes known as "upwash," a phenomenon that reduces the effective sail area for prior art sails. However, because middle region 82 is the first portion of the assembly struck by the wind and because the curved mast lying below this region falls away to leeward, the present invention creates a "downwash" effect on the lower part of the sail. FIG. 12 shows how relative wind 86 is split into downwash 92 and upwash 94. This downwash effect keeps more of the available flow moving over the surface of the sail and increases the effective area of the sail in the present invention. This is another reason for locating the middle region of the curved mast further to the windward side of the mast rotation axis. The ultimate limit—of course—is that more sail area must lie on the leeward side of the mast rotation axis than the windward side (otherwise the main sheet would become ineffective in controlling mast rotation).

As mentioned previously, conventional control devices can be combined with the present invention. For instance, the boom can be attached to the mast joint by a pivot which allows the boom to be adjusted up and down in the pitch axis. The boom can also be provided with a rotational adjustment to vary its angle with respect to the plane in which the curved mast lies. The attachment of the boom to the mast joint can also be made adjustable up and down (such as by using "boom jaws"). However—if some or all of such known adjustments are provided—they must still permit the boom to rotate in unison with the rest of the mast assembly.

Although the preceding description contains significant detail, it should not be construed as limiting the scope of the invention but rather as providing illustrations of the preferred embodiments of the invention. Many variations could be imagined within the scope of this disclosure. Accordingly, the scope of the invention should be defined by the following claims rather than any particular embodiment disclosed.

Having described my invention, I claim:

1. A sail supporting assembly for a sailing vessel having a hull with a keel and gunwales, comprising:

a. a straight mast, having a lower region and an upper region;

b. wherein said straight mast is pivotally attached to said hull so that said straight mast rotates around a mast rotation axis which is perpendicular to said keel;

c. wherein said upper region of said straight mast lies substantially above said gunwales;

d. a curved mast, having a lower region, a middle region, and an upper region;

e. wherein said lower region of said curved mast is joined to said upper region of said straight mast at a mast joint, so that said curved mast and said straight mast rotate in unison about said mast rotation axis;

f. wherein said mast rotation axis has a windward side and a leeward side;

g. wherein said lower region of said curved mast lies proximate said mast rotation axis;

h. wherein said middle region of said curved mast lies on said windward side of said mast rotation axis;

i. wherein said upper region of said curved mast lies on said leeward side of said mast rotation axis;

j. a boom, having a proximal end connected to said mast joint and a distal end located distal to said mast joint, said boom being configured to rotate in unison with said straight mast and said curved mast;

k. a sail attached to said curved mast and said boom, said sail defining a sail area;

l. wherein at least 5% of said sail area lies on said windward side of said mast rotation axis;

m. a curved mast extender, slidably connected to said upper region of said curved mast; and n. wherein when said curved mast extender is extended upward, said curved mast extender extends the overall height of said mast assembly.

* * * * *